US011066232B2

(12) United States Patent
Valsecchi

(10) Patent No.: US 11,066,232 B2
(45) Date of Patent: Jul. 20, 2021

(54) BEVERAGE PREPARATION CAPSULE

(71) Applicant: Gruppo Gimoka S.r.l, Trezzano sul Naviglio (IT)

(72) Inventor: Massimiliano Valsecchi, Andalo Valtellino (IT)

(73) Assignee: Gruppo Gimoka S.r.l., Trezzano sul Naviglio (IT)

( * ) Notice: Subject to any disclaimer, the term of this patent is extended or adjusted under 35 U.S.C. 154(b) by 0 days.

(21) Appl. No.: 16/955,386

(22) PCT Filed: Dec. 21, 2018

(86) PCT No.: PCT/IB2018/060517

§ 371 (c)(1),
(2) Date: Jun. 18, 2020

(87) PCT Pub. No.: WO2019/123415

PCT Pub. Date: Jun. 27, 2019

(65) Prior Publication Data

US 2021/0094753 A1 Apr. 1, 2021

(30) Foreign Application Priority Data

Dec. 21, 2017 (EP) ..... 17209750
Apr. 19, 2018 (IT) ..... 102018000004732

(51) Int. Cl.
*B65D 85/804* (2006.01)

(52) U.S. Cl.
CPC ..... *B65D 85/8052* (2020.05); *B65D 85/8043* (2013.01)

(58) Field of Classification Search
CPC ..... B65D 85/8043; B65D 85/8052
See application file for complete search history.

(56) References Cited

FOREIGN PATENT DOCUMENTS

WO 2006021405 A2 3/2006
WO 2008116818 A1 10/2008
(Continued)

OTHER PUBLICATIONS

Search Report from related Italian Patent Application No. IT201800004732 dated Nov. 28, 2018.
(Continued)

*Primary Examiner* — Viren A Thakur
*Assistant Examiner* — Chaim A Smith
(74) *Attorney, Agent, or Firm* — McCarter & English, LLP

(57) ABSTRACT

A capsule for preparing beverages in an automatic beverage preparation device, comprising an insert, which divides the capsule inner volume into an upper chamber intended to contain a beverage preparation substance, and a lower chamber for beverage collection and outflow. The insert comprises a relatively rigid disc, which is provided with a number of passages designed to establish a communication between the upper chamber and the lower chamber, and has, on the lower face of the disc facing the lower chamber, some beverage outflow channels communicating with the upper chamber through the passages. The insert further comprises a membrane permanently connected to the lower face of the disc except for one or more areas so as to define, together with the areas, respective membrane valves configured to open under the effect of the beverage pressure, so that the beverage flows out from the upper chamber to the lower chamber, and to close again when the effect of the beverage pressure ends.

8 Claims, 7 Drawing Sheets

(56) References Cited

FOREIGN PATENT DOCUMENTS

| | | | |
|---|---|---|---|
| WO | 2016135581 | A1 | 9/2016 |
| WO | 2017145091 | A1 | 8/2017 |
| WO | 2018025119 | A1 | 2/2018 |

OTHER PUBLICATIONS

International Search Report and Written Opinion from related International Patent Application No. PCT/IB2018/060517 dated Feb. 2, 2019.

BEVERAGE PREPARATION CAPSULE

CROSS-REFERENCE TO RELATED APPLICATIONS

This patent application is a 35 U.S.C. § 371 National Stage filing of International Application No. PCT/IB2018/060517, filed on Dec. 21, 2018, which application claims priority from European Patent Application No. 17209750.3, filed on Dec. 21, 2017, and Italian Patent Application No. 102018000004732 filed on Apr. 19, 2018, the entire disclosures of which are incorporated by reference herein.

TECHNICAL FIELD OF THE INVENTION

The present invention relates to a beverage preparation capsule.

In particular, the present invention relates to a capsule intended to be used in an automatic device for preparing beverages, and comprising a cup-shaped body, which is closed by a lid designed to be perforated to allow a pressurized fluid to be injected into the capsule, and is provided with a beverage outlet and an insert arranged within the cup-shaped body so as to divide the inner volume of the capsule into an upper chamber, intended to contain a beverage preparation substance, and a lower chamber for the beverage collection and outflow. The insert is provided with a number of passages intended to put the upper and lower chambers into communication.

A capsule of the type specified above is known, for example, from WO 2017/145091 A1 in the name of the present Applicant.

STATE OF THE ART

As is known, one of the needs mostly felt by the producers of capsules for preparing beverages in automatic devices is trying to eliminate the annoying phenomenon of the beverage dripping from the capsule at the end of the beverage dispensing. This dripping is due to the fact that, inevitably, when the injection of pressurized water inside the capsule stops and the beverage dispensing is interrupted, liquid residues in the capsule outflow therefrom by gravity through the beverage outlet, and collect in the collection tray, which must therefore be emptied with a certain frequency. If the capsule is then manually removed from the automatic device immediately after the beverage dispensing, the leakage of these liquid residues is even more annoying because, if the capsule is handled carelessly, it can cause burns on hands and/or beverage dripping on surfaces around the automatic device.

To overcome this drawback, capsule producers have provided the most varied solutions, some of which are disclosed in EP 1 579 792 B2, EP 1784 344 B1, EP 186 4917 B1, EP 1 908 706 B1, EP 2 029 458 B1, EP 2 892 824 B1, EP 2 892 824 B1, and ES 2 446 641 B1.

OBJECT AND SUMMARY OF THE INVENTION

The Applicant has found that the prior art solutions, although satisfactory in some respects, have a large margin of improvement with regard to the effectiveness of the function performed and/or the way in which the result is obtained.

The object of the present invention is to provide an improved capsule of the type specified above, which capsule allows the aforementioned drawback to be simply and effectively eliminated.

According to the present invention, a beverage preparation capsule is provided, as claimed in the appended claims.

DETAILED DESCRIPTION OF A PREFERRED EMBODIMENT OF THE INVENTION

The present invention will now be described in detail with reference to the attached Figures to allow a person skilled in the art to manufacture and use it. Various modifications to the described embodiments will be immediately apparent to those skilled in the art and the generic principles described may be applied to other embodiments and applications without thereby departing from the scope of the present invention, as defined in the appended claims. Therefore, the present invention should not be considered limited to the embodiments described and shown, but it should be granted the widest scope of protection in accordance with the principles and features disclosed and claimed herein.

Figure 1:
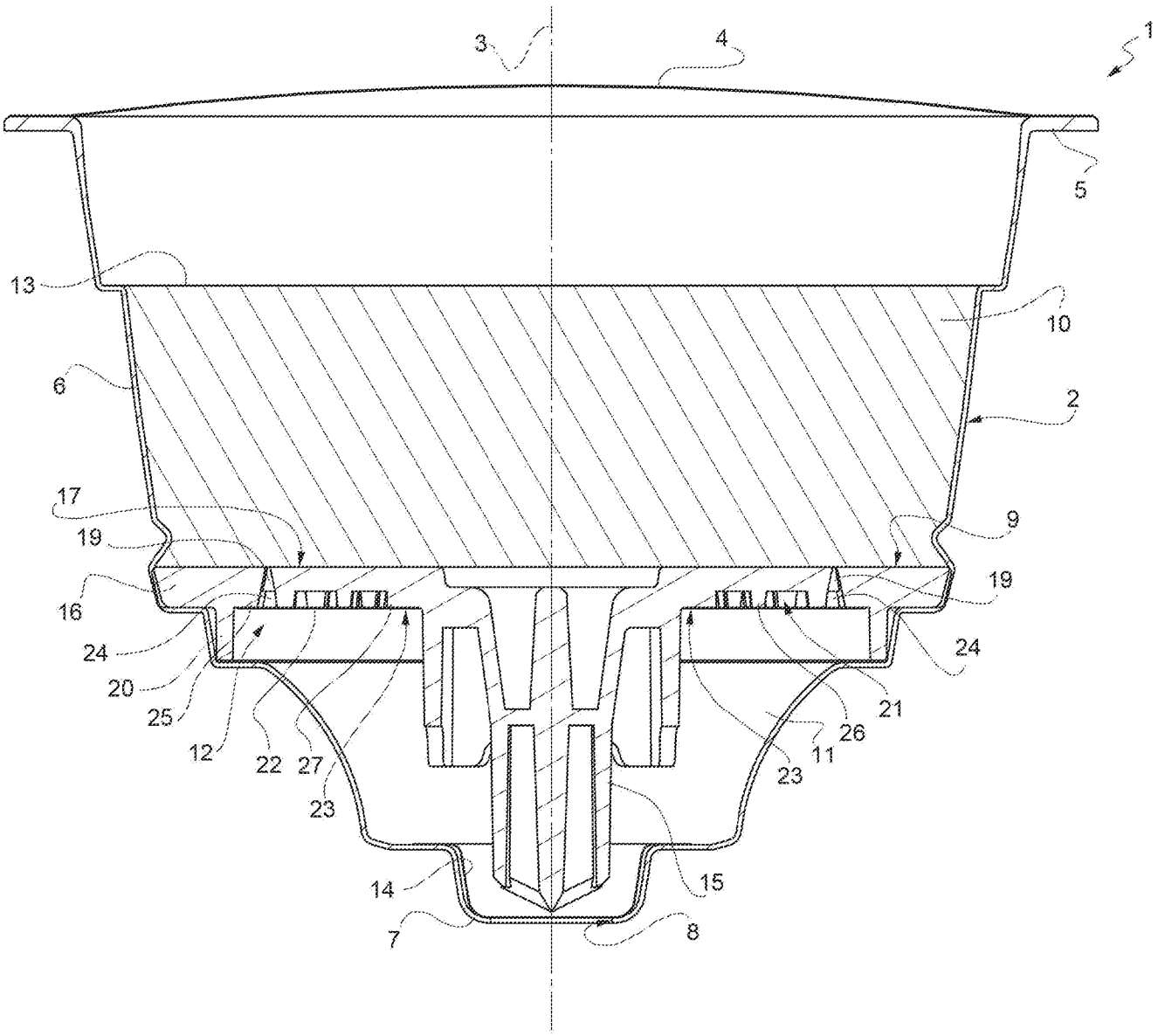
FIG. 1 shows a cross-section of a preferred embodiment of a capsule according to the present invention.

In FIG. 1, reference numeral 1 indicates as a whole a capsule intended to contain an infusion substance or a soluble substance for the production of a beverage, such as, for example, coffee, tea, chocolate, milk, broth, etc.

The capsule 1 is intended to be used in known infusion devices (not shown), in which the beverage production process envisages sealing the capsule in a seat and supplying in the capsule an infusion fluid, normally hot water, at a determined pressure so as to brew or dissolve the infusion substance in the capsule and produce a corresponding beverage.

As shown in FIG. 1, the capsule 1 comprises a cup-shaped body 2, which has a longitudinal axis 3 and is closed at an upper end by a lid 4 consisting of a single-layer or multi-layer film of plastic and/or metal material and fluid-tight welded to an outer annular flange 5 of the cup-shaped body 2 and intended to be perforated, during use, by a perforating device (not shown) of the beverage production device to allow the infusion fluid to be injected into the capsule 1 at the predetermined temperature and pressure.

The cup-shaped body 2 comprises a lateral wall 6, which is coaxial to the axis 3 and preferably, but not necessarily, has a generally frustoconical shape flared towards the annular flange 5, and a bottom wall 7, which extends into a direction substantially transverse to the axis 3 and has a beverage outlet 8.

The cup-shaped body 2 is made of an impermeable material, preferably a multi-layer plastic material for food use, such as polypropylene (PP) or polybutylene terephthalate (PBT), and can be obtained by any suitable forming method, in particular by thermoforming.

As shown in FIG. 1, the capsule 1 further comprises an insert 9, which is arranged inside the capsule 1 and extends transversely to the axis 3 so as to divide the inner volume of the capsule 1 into an upper chamber 10, which is intended to contain the infusion substance or the soluble substance, and into a lower chamber 11, in which, during use, the beverage produced by infusion or solution in the upper chamber 10 collects before flowing out of the capsule 1 through the beverage opening 8.

As will be described in detail below, the insert 9 is part of a beverage flow control device 12, which acts both during the beverage dispensing phase in order to obtain a determined result in the cup and once the dispensing phase has ended in order to prevent any beverage residues from dripping out of the capsule 1 through the beverage opening 8.

Depending on the type of substance to be infused or dissolved and on the required amount and/or degree of compaction for the beverage to be produced, the upper chamber 10 can be completely or only partially filled with the substance. In some cases, as for example in the shown case, when the substance does not fill the entire volume of the chamber 10, a micro-perforated sheet 13 is placed on the substance and welded to the lateral wall 6 at a certain distance from the lid 4. The micro-perforated sheet 13 carries out the function of improving the extraction as it promotes an even distribution and penetration of the infusion fluid into the substance when the infusion fluid is injected into the capsule 1.

Figure 2:
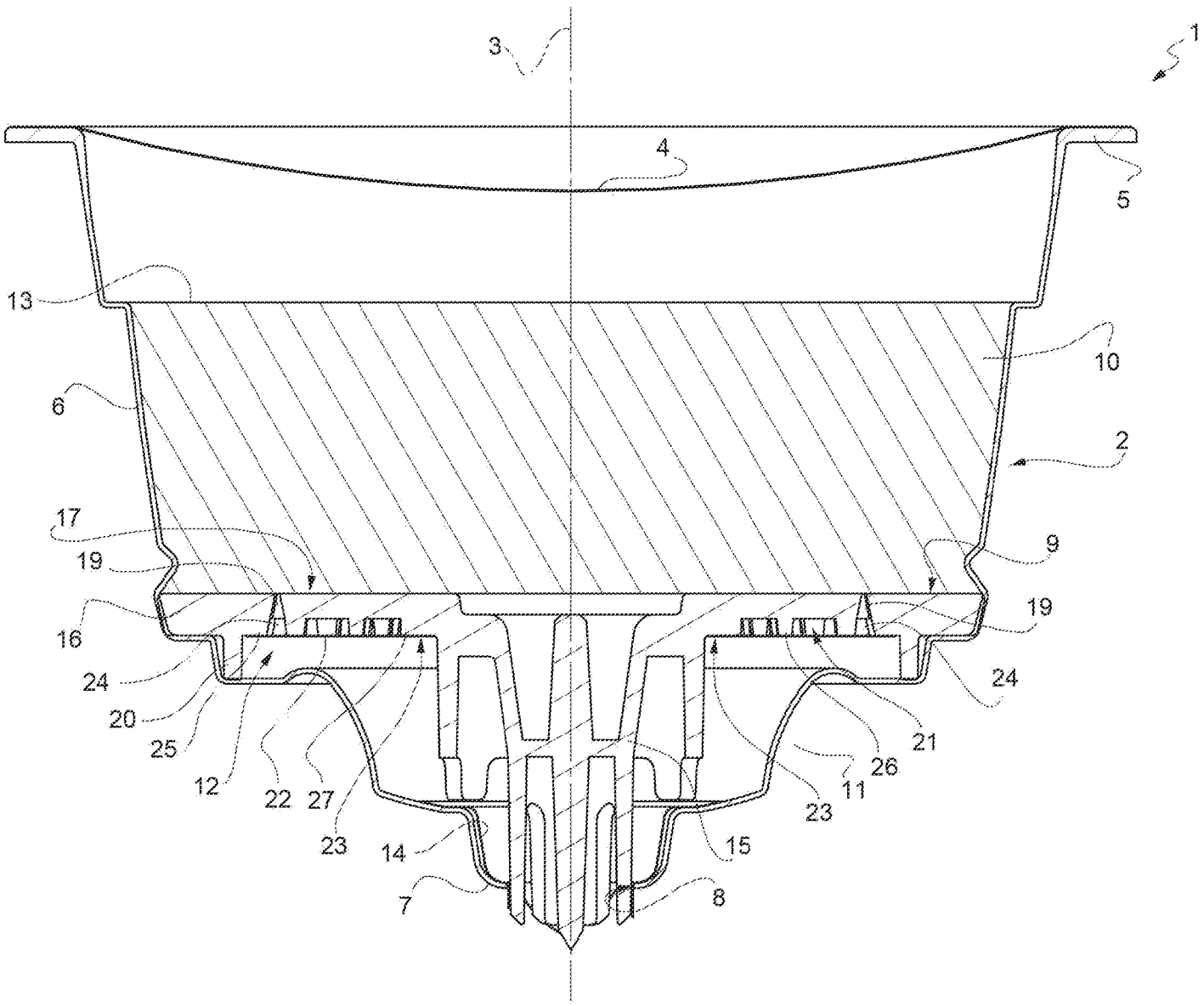
FIG. 2 shows the capsule of FIG. 1 in a different operating configuration.
Figure 3:
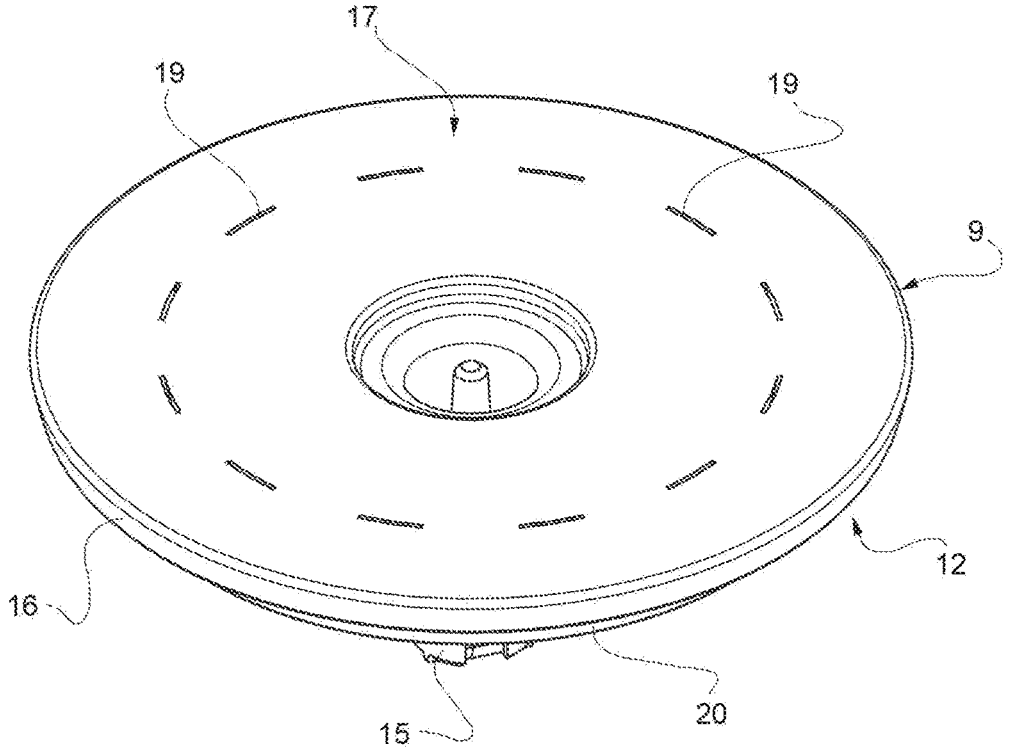
FIGS. 3 and 4 are perspective views from different angles of a detail of the capsule of FIG. 1.
Figure 4:
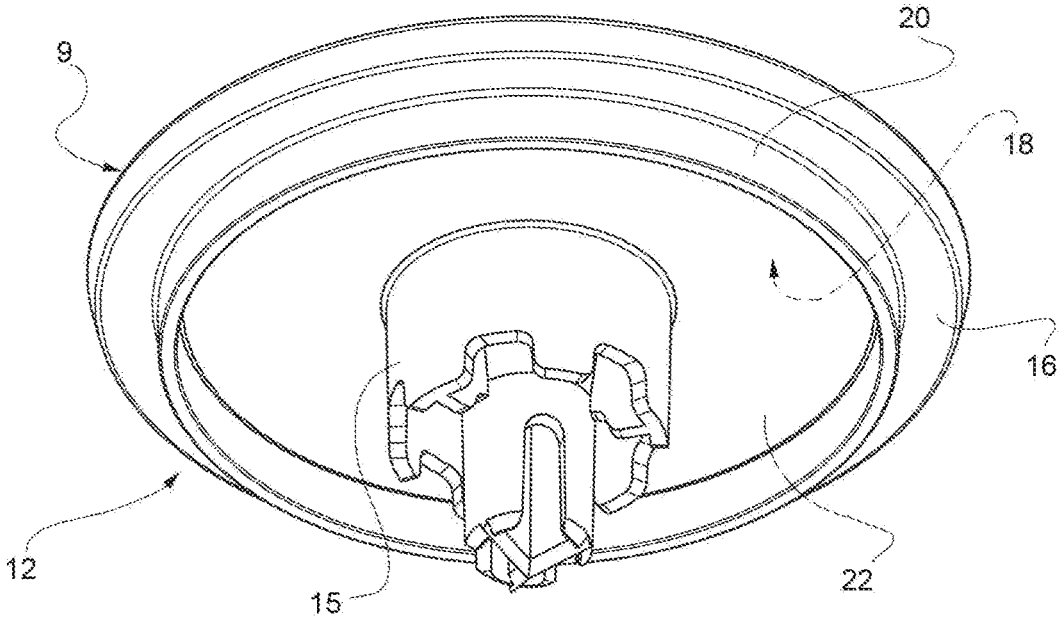

According to a preferred embodiment, the beverage opening 8 is sealed by a film 14 and the insert 9 is provided with a tip 15, which extends in the lower chamber 11 in a direction substantially parallel to the axis 3. The tip 15 has the function of perforating, during use, the film 14, thus opening the beverage opening 8, when the capsule 1, after being placed in the seat of the infusion device, is compressed in the axial direction, normally by closing the seat lid, which causes a local deformation of the lateral wall 6 of the capsule 1 between the insert 9 and the beverage opening 8, with the consequent displacement of the tip 15 towards, and through, the film 14 (FIG. 2).

With regard to the foregoing, it is worth noting that what will be described below with regard to the beverage flow control device 12 occurs regardless of the presence or absence of the tip 15 and, in general, of the type of capsule opening, for example, when the sealing film 14 is absent or is manually removable before use or is intended to be perforated by an external element without any axial compression of the capsule.

As shown in FIG. 1 and, in greater detail, in FIGS. 3 to 6, the insert 9 comprises a relatively rigid disc 16, preferably made of plastic, which is bound, towards the upper chamber 10, by an upper face 17 and, towards the lower chamber 11, by a lower face 18, and is provided with a certain number of passages 19 extending from the upper face 17 to the lower face 18 in a direction generally parallel to the axis 3.

The disc 16 may be firmly fastened to the lateral wall 6 by interlocking, gluing or in any other way suitable for the purpose.

According to the preferred embodiment shown in the accompanying figures, the disc 16 rests on an annular portion of the lateral wall 6 lying on a plane transverse to the axis 3, and is axially locked against the annular portion by means of a fastening annular element integral with the lateral wall 6, preferably consisting of an annular recess of the lateral wall 6, which engages a peripheral area of the upper face 17.

On the lower face 18, near its outer edge, the disc 16 preferably has an annular rib 20, which extends, coaxially to the axis 3, from the lower face 18 to an annular portion 22 of the lateral wall 6 lying on a plane transverse to the axis 3. The annular rib 20 contributes to the stability of the position of the insert 9 when, during use, the capsule 1 is axially compressed and the lateral wall 6 is deformed in the area between the insert 9 and the bottom wall 7 (FIG. 2).

When present, the annular rib 20 externally delimits the area of the disc 16 with the passages 19. However, according to a variant not shown, the annular rib 20 may be missing and, in this case, the passages 19 may be formed in any area of the disc 16, provided they face the lower chamber 11.

On the lower face 18, the disc 16 has one or more beverage outflow channels 21, which communicate with the upper chamber 10 through the passages 19, and a membrane 22, which is part of the beverage flow control device 12 and is permanently connected to the surface of the lower face 18, with the exception of one or more areas 18*a* where the membrane 22 is adherent but not connected to the lower face 18 so as to define, in each area 18*a*, a corresponding membrane valve 23.

As better explained below, the membrane valves 23 are configured to take a normal closed configuration, in which the membrane 22 is adherent to the disc 16, and to switch, under the effect of the beverage pressure, from the normal closed configuration to an open configuration in which the membrane 22 is spaced apart from the disc 16 to allow the pressurized beverage to flow out from the upper chamber 10 to the lower chamber 11. When the effect of the beverage pressure ends, the membrane 22 automatically returns to the closed configuration adhering to the lower face 18 to stop the beverage outflow.

The membrane valves 23 are shaped so that, when the membrane 22 is spaced apart from the lower face 18, the membrane 22 forms, with the non-welded areas of the lower face 18, beverage outflow channels substantially radial relative to the axis 3.

According to what shown in the attached figures, particularly in FIGS. 3 to 7, the inlets of the passages 19 on the upper face 17 are shaped as slots formed on an annular portion of the disc 16. In particular, the passages/slots 19 are evenly distributed along a circumference coaxial to the axis 3 and radially internal relative to the rib 20.

The inlets of the passages 19 on the upper face 17 are sized so as to filter the beverage produced in the upper chamber 10, thus preventing any solid residue of the infusion substance from clogging the passages 19. According to a variant (not shown), the upper face 17 may possibly be covered by a sheet of water-permeable material, e.g. a sheet of filter paper or non-woven fabric fibres.

The passages 19 open onto the lower face 18 at respective recesses 24 (FIGS. 5, 7 and 8), which are distributed along a circumference coaxial to the axis 3 and are surrounded by a continuous outer annular edge 25, which is also coaxial to the axis 3.

The recesses 24 are in fluidic communication with the outflow channels 21, which constitute a labyrinth formed by a plurality of concentric annular recesses in fluidic communication with each other through radial recesses and defining, between them and with the annular recesses, a plurality of raised elements 26.

The outflow channels 21 therefore define a tortuous path made of narrow passages and small expansion chambers, which, when flown by the pressurized beverage, dampen the beverage energy by friction and, thanks to the action of the edges of the raised elements 26, promote the emulsion of the beverage.

As mentioned above, the membrane 22 is permanently connected to the disc 16 over the whole surface of the lower face 18, with the exception of the areas 18*a*.

In the example shown in the attached figures, in which the disc 16 is provided with the tip 15, the labyrinth extends on an annular portion of the lower face 18 and is radially internally bound by a continuous inner annular edge 27, which is concentric to the outer annular edge 25.

Figure 6:
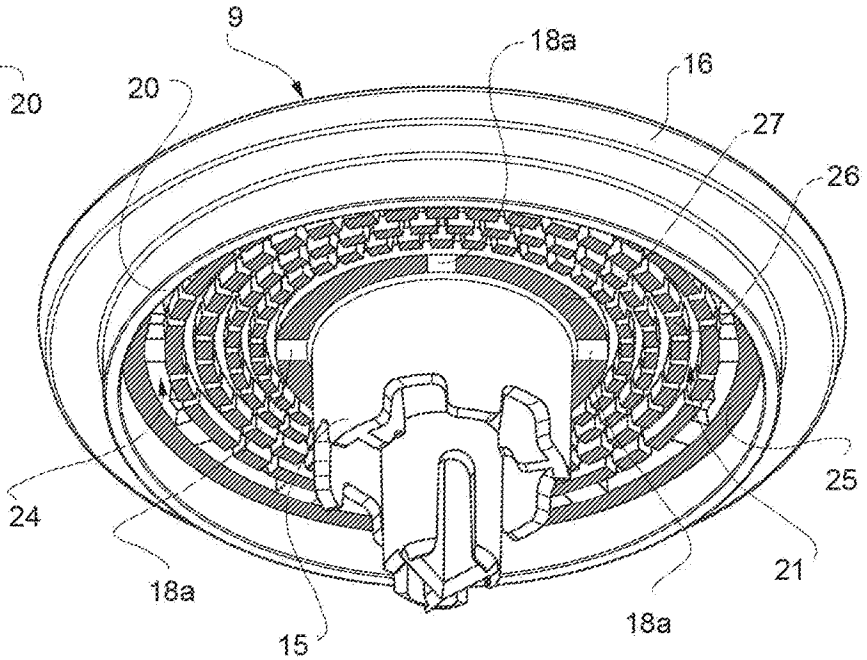
FIG. 6 shows the detail of FIG. 4 with a part removed for clarity's sake.
Figure 5:
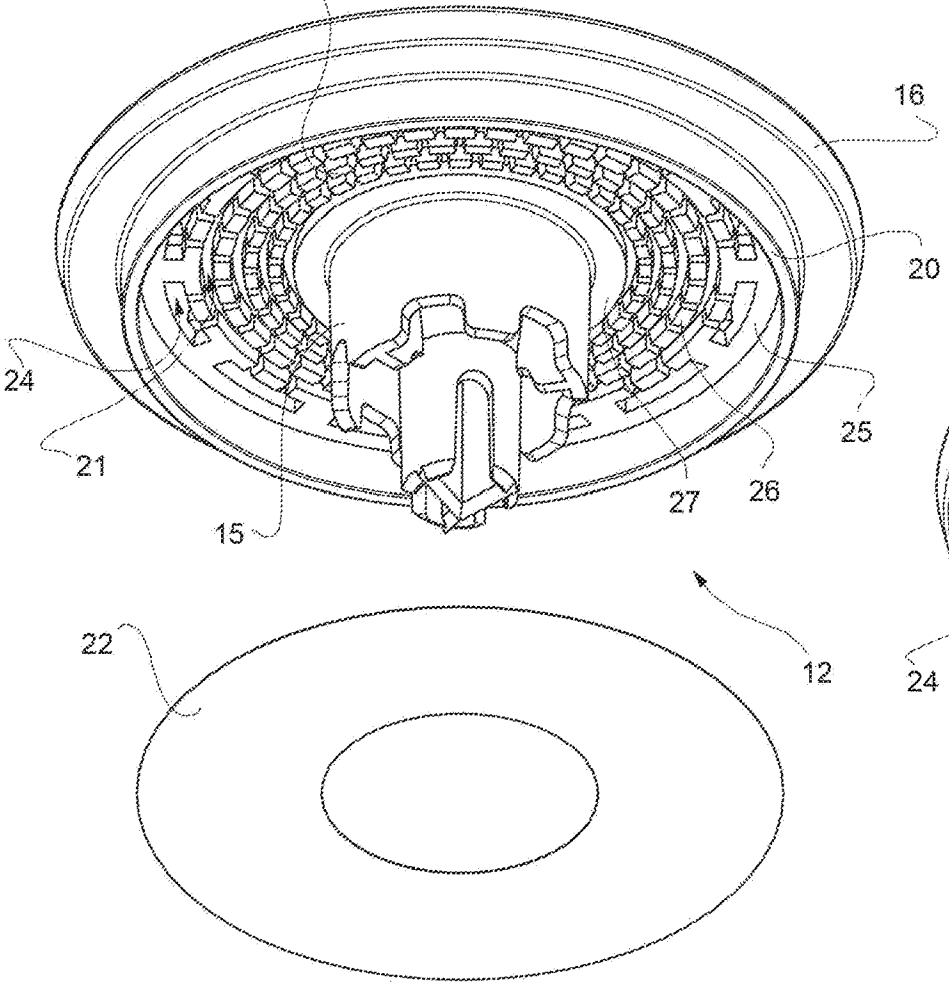
FIG. 5 is an exploded perspective view of the detail shown in FIGS. 3 and 4.
Figure 7:
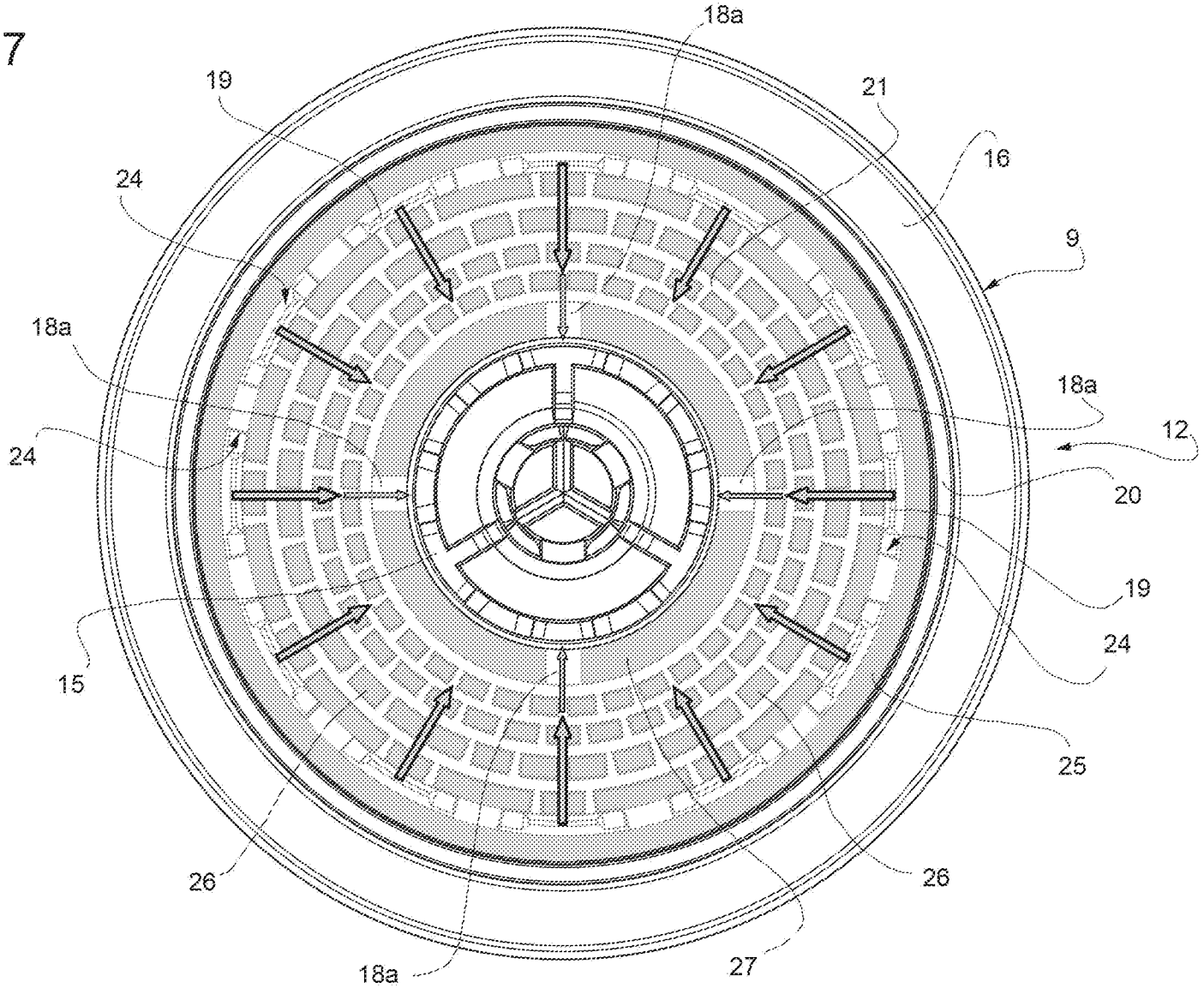
FIG. 7 is a bottom view of the detail of FIG. 4, in which a part is shown in semi-transparency for clarity's sake.

As shown in FIGS. 6 and 7, in this case, the areas 18*a* are arranged on the inner annular edge 27, while the membrane 22 is connected to the remaining part of the surface (coloured in grey) of the lower face 18, namely to the outer annular edge 25, to the raised elements 26 and to the surface of the inner annular edge 27 between the areas 18*a*.

As clearly visible in FIGS. 6 and 7, the areas 18*a* are constituted by four radial sectors of the top surface of the inner annular edge 27, angularly equidistant around the axis 3. The number of sectors depends on design choices that take into account different factors, including dispensing parameters, in particular dispensing pressure, and the type of beverage to be produced. According to variants not shown, the number of sectors may be higher or lower than the shown example and, at a minimum, may be equal to one.

Preferably, the top surfaces of the outer annular edge 25, of the raised elements 26 and of the inner annular edge 27 are mutually coplanar. According to a variant, these three top surfaces may lie on different planes provided that they allow a simultaneous welding of the membrane 22 to all three surfaces.

Figure 8:
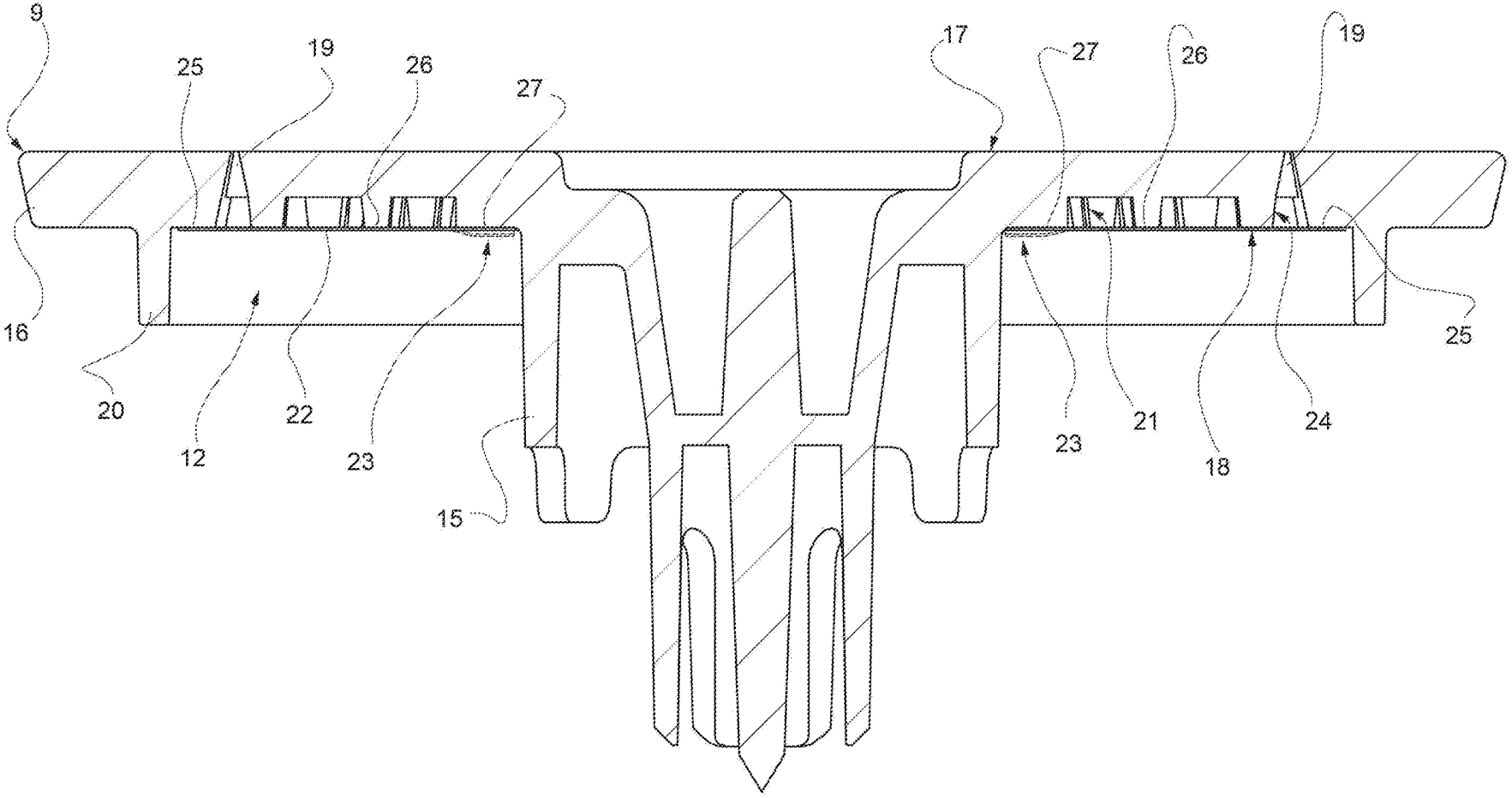
FIG. 8 shows a cross-section of the detail of FIG. 4 in two different operating configurations.

As shown in FIGS. 7 and 8, at rest, before the injection of the pressure infusion fluid into the upper chamber 10, the membrane 22 adheres to the areas 18*a* and the corresponding membrane valves 23 are in the closed position (shown with a continuous line in FIG. 8).

Figures 9, 10:
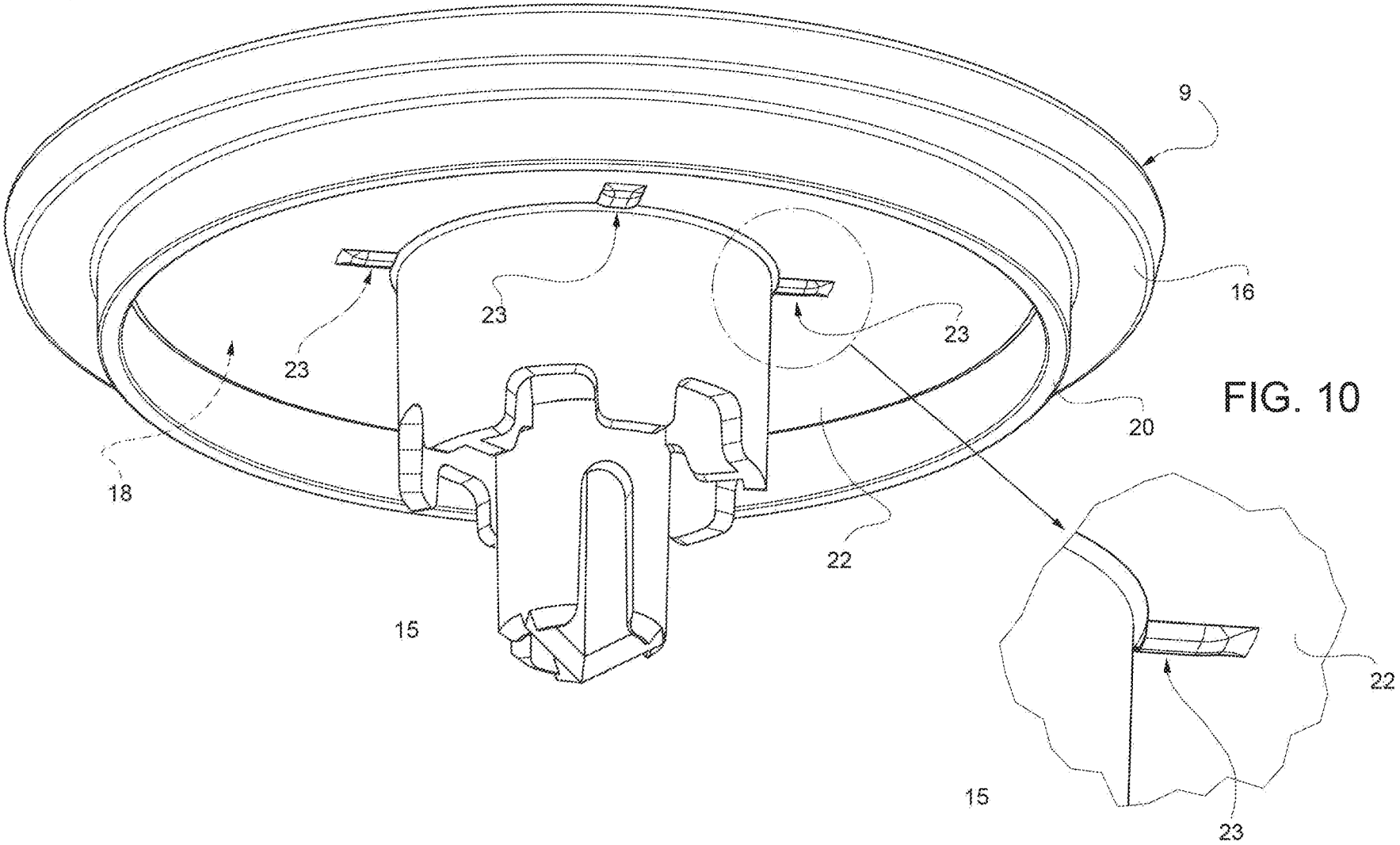
FIG. 9 is a perspective bottom view of the detail shown in FIG. 8.
FIG. 10 shows a detail of FIG. 9 on an enlarged scale.

After the infusion fluid has been injected into the upper chamber 10 and upon reaching a certain pressure value in the upper chamber 10, the pressurized beverage flows out of the upper chamber 10 through the passages 19 and flows through the outflow channels 21 from the periphery towards the centre of the disc 16, up to the inner annular edge 27. The beverage pressure lifts the membrane 22 at the areas 18*a*, so as to bring the corresponding membrane valves 23 into the open position (shown in FIG. 8 with a dashed line and in FIGS. 9 and 10) and to allow the beverage to flow into the lower chamber 11 and then externally through the opening 8.

The membrane 22 is preferably made of a flexible sheet of plastic material or other material having a high tensile strength so as not to break or tear during the dispensing process.

When the injection of infusion fluid ceases and, consequently, the pressure in the upper chamber 10 drops, any liquid residues still present in the upper chamber 10 and in the outflow channels 21 do not have sufficient force to keep the membrane 22 detached from the disc 16 in the areas 18*a*. The consequent return of the membrane 22 in a position adhering to the disc 16 causes the membrane valves 23 to close and the liquid outflow to instantaneously interrupt.

For the sake of completeness, it is worth noting that the application of the inventive principle that is the basis of the beverage flow control device 12 is not dependent on the mutual position of the passages 19 and of the membrane valves 23 on the disc 16, i.e., on the fact that the direction of the beverage in the labyrinth is centripetal or centrifugal. For example, in a variant (not shown), the passages 19 may be formed on a central portion of the disc 16 and the membrane valves 23 may be arranged at an external peripheral portion of the disc 16 so that, during use, the beverage flows along the outflow channels 21 from the centre towards the periphery of the disc 16.

This latter configuration is particularly advantageous in the case of a capsule that does not include a tip 15. In this case, in fact, the membrane 22 may be shaped as a disc and the passages 19 may be arranged in the centre of the disc 16 and be possibly formed by a single central passage, preferably coaxial to the axis 3.

From the foregoing it is therefore clear that the advantage of the present invention is realizing an effective beverage flow control both during the dispensing phase and at its end through the synergistic association of only two components, namely the disc, which carries the outflow channels and defines the support for the membrane, and the membrane, which delimits the outflow channels to define the labyrinth and cooperates with the disc to define the anti-dripping valve system.

The invention claimed is:

1. A capsule for preparing a beverage in an automatic beverage preparation device; wherein the capsule (1) comprises a cup-shaped body (2) designed to be closed by a lid (4) intended to be perforated to allow a pressurised fluid to be injected into the capsule (1); the cup-shaped body (2) has a longitudinal axis (3) and comprises a lateral wall (6) and a bottom wall (7) with a beverage outlet (8);

the capsule (1) further comprises an inner insert (9) extending transversally to the longitudinal axis (3) to divide the capsule inner volume into an upper chamber (10) intended to contain a beverage preparation substance, and a lower chamber (11) for beverage collection and outflow;

the insert (9) comprises a disc (16) with a number of passages (19) designed to establish a fluidic communication between the upper chamber (10) and the lower chamber (11);

characterised in that the disc (16) comprises one or more beverage outflow channels (21) formed in a lower face (18) of the disc (16) facing the lower chamber (11) and communicating with the upper chamber (10) through the passages (19);

and by a membrane (22) permanently connected to the lower face (18) of the disc (16), except for one or more areas (18*a*) so as to define, together with said areas (18*a*), respective membrane valves (23) configured to switch, under the effect of the beverage pressure, between a normal closed configuration, in which the membrane (22) adheres to the disc (16) and prevents the beverage from flowing therethrough, and an open configuration, in which the membrane (22) is spaced apart from the disc (16) and allows the beverage to flow from the upper chamber (10) to the lower chamber (11).

2. The capsule of claim 1, wherein the membrane valves (23) are configured so that, when in the open configuration, the beverage flows out from the membrane valves (23) in radial directions relative to the longitudinal axis (3).

3. The capsule of claim 1, wherein the beverage outflow channels (21) formed in the lower face (18) of the disc (16) define a labyrinth path, which the beverage flows in through the passages (19) and flows out through the membrane valves (23), when in the open configuration.

4. The capsule of claim 1, wherein the beverage outflow channels (21) are formed in an annular area of the lower face (18) of the disc (16) around the longitudinal axis (3) and define a plurality of raised elements (26); the annular area is radially delimited by continuous outer and inner annular edges (25, 27).

5. The capsule of claim 4, wherein the passages (19) are arranged between the outer annular edge (25) and the beverage outflow channels (21), and the areas (18*a*) are defined by radial sectors of the inner annular edge (27); the membrane (22) is permanently connected to the remainder of the inner annular edge (27), to the outer annular edge (25), and to the raised elements (26).

6. The capsule of claim 4, wherein the passages (19) are arranged between the inner annular edge (27) and the beverage outflow channels (21), and the areas (18*a*) are defined by radial sectors of the outer annular edge (25); the membrane (22) is permanently connected to the remainder of the outer annular edge (25), to the inner annular edge (27), and to the raised elements (26).

7. The capsule of claim 1, wherein the membrane (22) is either welded or glued to the lower face (18) of the disc (16).

8. The capsule of claim 1, wherein the disc (16) is made of a plastic material, and the membrane (22) is formed by a flexible sheet having a tensile strength such as not to break or tear during the beverage dispensing process.

* * * * *